US008202336B1

(12) United States Patent
Moe et al.

(10) Patent No.: US 8,202,336 B1
(45) Date of Patent: Jun. 19, 2012

(54) SYSTEM FOR SEPARATION AND CONTAINMENT OF SOLIDS, LIQUIDS, AND GASES

(75) Inventors: Edward Beverly Moe, Willis, TX (US); James Wesley Griffin, Willis, TX (US); Clifford Cantlon, Montgomery, TX (US)

(73) Assignee: Tri-Flo International, Inc., Willis, TX (US)

( * ) Notice: Subject to any disclaimer, the term of this patent is extended or adjusted under 35 U.S.C. 154(b) by 0 days.

(21) Appl. No.: 13/303,678

(22) Filed: Nov. 23, 2011

Related U.S. Application Data

(60) Provisional application No. 61/417,124, filed on Nov. 24, 2010, provisional application No. 61/417,128, filed on Nov. 24, 2010.

(51) Int. Cl.
*B01D 50/00* (2006.01)

(52) U.S. Cl. ..... 55/318; 55/315; 55/447; 55/462; 55/463; 55/464; 55/465; 55/430; 55/431; 55/432; 55/433

(58) Field of Classification Search ..... 55/315, 55/447, 462–465, 318, 430–433
See application file for complete search history.

(56) References Cited

U.S. PATENT DOCUMENTS

| | | | | |
|---|---|---|---|---|
| 1,328,522 | A | | 10/1916 | Jones |
| 2,135,589 | A | | 11/1938 | Monson |
| 2,994,432 | A | | 6/1957 | Schluter |
| 3,570,221 | A | * | 3/1971 | Oliver ..... 5/418 |
| 3,765,153 | A | * | 10/1973 | Grey ..... 96/48 |
| 3,885,929 | A | * | 5/1975 | Lyon et al. ..... 95/154 |
| 4,459,207 | A | | 7/1984 | Young |
| 4,474,254 | A | | 10/1984 | Etter et al. |
| 4,526,687 | A | | 7/1985 | Nugent |
| 4,788,825 | A | * | 12/1988 | Calupca et al. ..... 62/84 |
| 4,846,976 | A | | 7/1989 | Ford |
| 4,931,190 | A | | 6/1990 | Laros |
| 5,173,195 | A | | 12/1992 | Wright et al. |
| 5,236,605 | A | | 8/1993 | Warncke |
| 5,244,579 | A | | 9/1993 | Horner et al. |
| 5,344,573 | A | | 9/1994 | Hill et al. |
| 5,601,659 | A | | 2/1997 | Rohrbacher |
| 5,626,748 | A | | 5/1997 | Rose |
| 5,853,583 | A | | 12/1998 | Shah |
| 5,932,091 | A | | 8/1999 | Tomkins et al. |
| 6,110,382 | A | | 8/2000 | Wiemers et al. |
| 6,890,431 | B1 | | 5/2005 | Eades et al. |

(Continued)

FOREIGN PATENT DOCUMENTS

WO WO2007028894 A1 3/2007

*Primary Examiner* — Jason M Greene
*Assistant Examiner* — Dung H Bui
(74) *Attorney, Agent, or Firm* — Buskop Law Group, PC; Wendy Buskop

(57) ABSTRACT

A system for capturing and separating solids, liquids, and gases, such as during air drilling of a well, can include a cylindrical vessel with an inlet for receiving an input. A target plate can impact the input, remove solid and liquid therefrom, and direct flow from the inlet, forming a vortex. A first chevron baffle, a second chevron baffle, and a demister baffle can further remove solid and liquid from the input, forming a cleaned gas. The cleaned gas can be burned, the solid can be dried, and the liquid can be recycled for reuse in drilling operations.

15 Claims, 10 Drawing Sheets

U.S. PATENT DOCUMENTS

| | | | |
|---|---|---|---|
| 7,727,389 | B1 | 6/2010 | Mallonee et al. |
| 7,731,840 | B1 | 6/2010 | Mallonee et al. |
| 2003/0136747 | A1 | 7/2003 | Wood et al. |
| 2005/0040119 | A1 | 2/2005 | Kulbeth |
| 2005/0139530 | A1 | 6/2005 | Heiss |
| 2007/0163959 | A1 | 7/2007 | Cote et al. |
| 2009/0211974 | A1 | 8/2009 | Bonnelye et al. |

* cited by examiner

SYSTEM FOR SEPARATION AND CONTAINMENT OF SOLIDS, LIQUIDS, AND GASES

CROSS REFERENCE TO RELATED APPLICATION

The present application claims priority to and the benefit of co-pending U.S. Provisional Patent Application No. 61/417,124 filed on Nov. 24, 2010, entitled "SYSTEM FOR SEPARATION AND CONTAINMENT OF SOLIDS, LIQUID, AND GAS DURING AIR DRILLING OPERATIONS AND AFTER HYDRAULIC FRACTURING", and of U.S. Provisional Patent Application No. 61/417,128 filed on Nov. 24, 2010, entitled "METHOD FOR SEPARATION AND CONTAINMENT OF SOLIDS, LIQUID, AND GAS DURING AIR DRILLING OPERATIONS AND AFTER HYDRAULIC FRACTURING". These applications are incorporated in their entirety herewith.

FIELD

The present embodiments generally relate to a system for separating and containing solids, liquids, and gases, such as during air drilling of a well.

BACKGROUND

A need exists for a system for separating and containing solids, liquids, and gases that can be easily transported and quickly installed.

A further need exists for a system configured to receive an input, including solid, liquid, and gas, and to remove liquid and solid from the input, thereby allowing the gas to travel to a flare, the liquid to be reused in drilling operations or other operations, and the solid to be contained and dried.

A further need exists for a system that can handle up to 6000 cubic feet of input.

A further need exists for a system configured to operate at or near atmospheric pressure, providing a system that is safer, more efficient, and easier to implement.

The present embodiments meet these needs.

BRIEF DESCRIPTION OF THE DRAWINGS

The detailed description will be better understood in conjunction with the accompanying drawings as follows.

Figure 1:
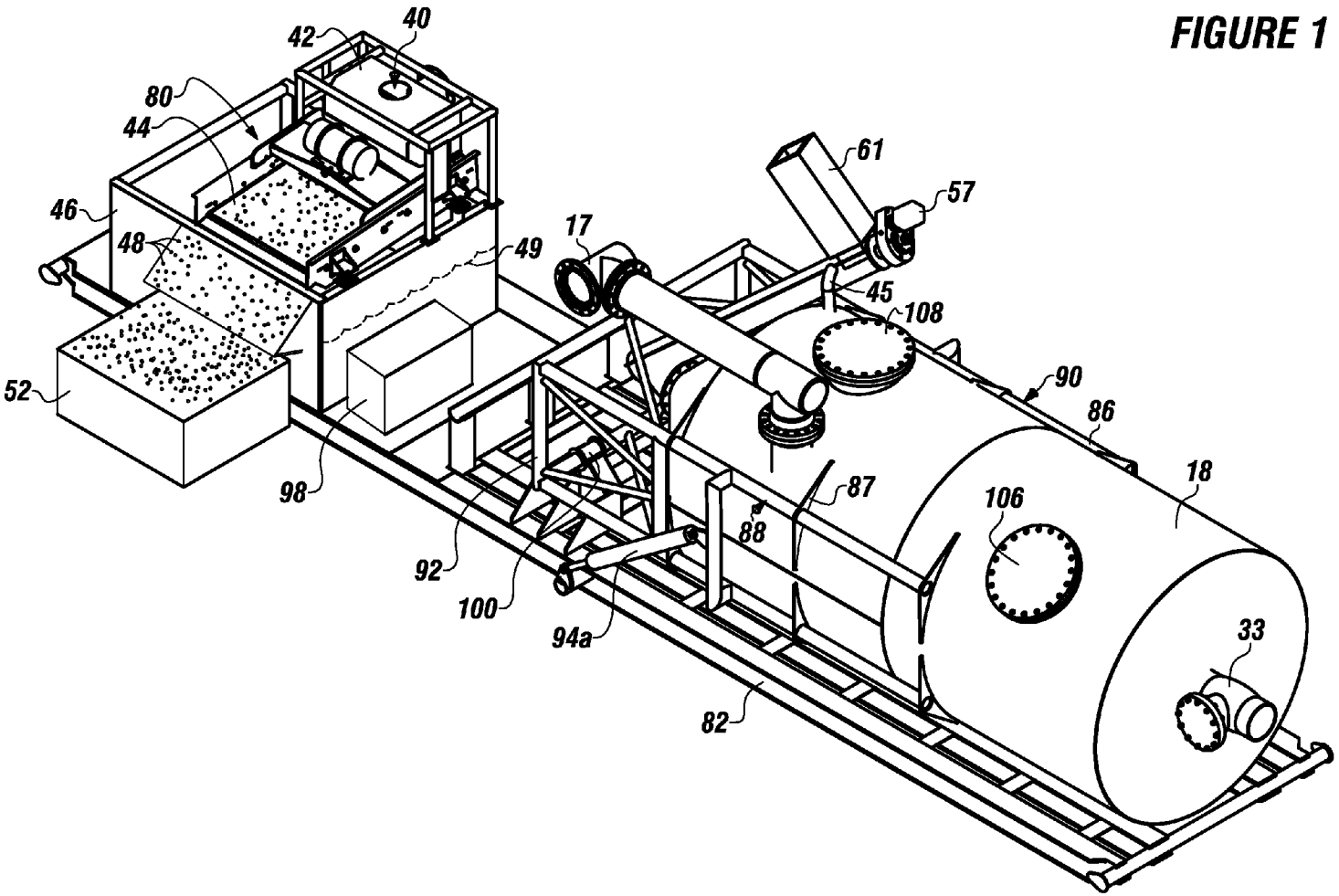
FIG. 1 depicts a perspective view of an embodiment of the system having a vessel and an auger for capturing and separating solid, liquid, and gas, according to one or more embodiments.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to a system for separating an input that can include solids, liquids, and gases. For example, the system can be used to separate solids, liquids, and gases during air drilling of a well, such as an oil well, gas well, water well, or any other type of drilled well. The system can also be used for containment and separation of solids, liquids, and gases during flow back after hydraulic fracturing.

The solids can include drill cuttings, the liquids can include water and hydrocarbons, and the gases can include air and natural gas.

The system can include a vessel. The vessel can be a single walled vessel configured for separation of solid, liquid, and gas at or near atmospheric pressure. The vessel can be configured to support a vortex flow of gas within the vessel.

The vessel can be adapted for a flow rate up to 6000 cubic feet of the input per minute for separating up to 1000 gallons of the liquid per minute from the input. The vessel can be used to separate the solid from the liquid. In one or more embodiments, the solid can constitute up to 20 percent of the quantity of the liquid and solid separated by the system.

The vessel can be a cylindrical vessel with a bottom, which can be a cone shaped bottom. In one or more embodiments, the vessel can have a diameter ranging from about 7.5 feet to about 9 feet. The vessel can be other sizes depending upon the application.

The vessel can be made of steel, polymer, other material, or combinations thereof. The vessel can be configured to be transported on an ordinary truck trailer without the need for permits, can be lightweight, easy to clean, and resistant to degradation.

The vessel can include an opening, such as an inlet, which can receive the input. The input can include the solids, liquids, and gases.

The input can be directed towards a middle section of the vessel to impact a target plate, which can allow at least a portion of the solids and liquids to fall to the bottom of the vessel.

The target plate can be disposed within the vessel adjacent to the inlet. The target plate can be positioned within the vessel such that the input impacts the target plate upon passage into the vessel through the inlet.

In operation, upon impact of the input with the target plate, the target plate can direct a first portion of the solid and liquid to flow towards a first portion of the vessel, such as the bottom of vessel, thereby forming a first partially cleaned input.

Also, upon impact of the input with the target plate, the target plate can direct the first partially cleaned input towards a second portion of the vessel, such as a top of the vessel.

The target plate can be disposed within the vessel and positioned at an angle, such as 45 degrees, allowing impact by the incoming input to deflect the liquids and solids, and allowing the gases to rise within the vessel.

By impacting the incoming input from the inlet at an angle, the target plate can initiate a vortex flow of the gases within the vessel. The vortex flow of the first partially cleaned input can be formed in the middle section of the vessel.

In one or more embodiments, the target plate can be made of steel, polymer, other material, or combinations thereof. The target plate can be positioned at an angle from about 20 degrees to about 45 degrees from the direction of the input flowing into the vessel from the inlet.

The target plate can be about 2 feet long, 2 feet wide and 1 inch thick. The target plate can have other dimensions depending upon the application. The target plate can be welded or otherwise fastened to an interior wall of the vessel.

One or more embodiments of the system can include a vortex maintenance ring that can be disposed in the middle section of the vessel. The vortex maintenance ring can be a circular ring of steel, polymer, other material, or combinations thereof disposed about a perimeter of the interior of the vessel.

The vortex maintenance ring can be connected to the inside of the vessel at an angle to the vertical axis of the vessel. The vortex maintenance ring can be disposed at an angle ranging from about 45 degrees to about 60 degrees to the vertical axis of the vessel.

In operation, the vortex maintenance ring can function to maintain the formed vortex flow of the input or partially cleaned input in the vessel.

The vortex maintenance ring can have an inner diameter of about 6 feet, and a thickness ranging from about ¼ of an inch to about ½ of an inch. The vortex maintenance ring can be made of solid steel. The vortex maintenance ring can be made of other materials and can have other dimensions depending upon the particular application.

The vessel can have a top section. A first baffle, such as a first chevron baffle, can be disposed in the top section across a portion of a diameter of the vessel. For example, the first chevron baffle can be disposed across approximately half of the vessel. The first chevron baffle can form a first chamber between the first chevron baffle and the top of the vessel.

The first chevron baffle can be welded or otherwise attached to interior walls of the vessel, such as around an inside perimeter of the vessel.

The first partially cleaned input can flow through the first chevron baffle into the first chamber.

The first chevron baffle can prevent passage of a second portion of the solid and liquid into the first chamber. For example, the first chevron baffle can be configured to separate the second portion of the solid and liquid from the first partially cleaned input when the first partially cleaned input flows through the first chevron baffle into the first chamber, thereby forming a second partially cleaned input.

The first chevron baffle can be configured to direct the second portion of the solid and liquid to flow towards the first portion of the vessel, such as the bottom of the vessel. The second portion of the solid and liquid can fall from the first chevron baffle to the bottom of the vessel. As such, the second partially cleaned input can be formed within the first chamber.

In one or more embodiments, the first chevron baffle can be semi-circular in shape and can have a diameter of about 8 feet.

In one or more embodiments, the second portion of the solid and liquid can include additional drilling cutting particles not affected by impact with the target plate, other particles resulting from the drilling process, water, hydrocarbons, or combinations thereof.

The second partially cleaned input can include air, natural gas, liquid, solid, or combinations thereof.

The second partially cleaned input can flow from the first chamber through a second chevron baffle. The second chevron baffle can be disposed in the vessel forming a second chamber.

The second chevron baffle can at least partially prevent passage of a third portion of the solid and liquid into the second chamber. For example, the second chevron baffle can be configured to separate a third portion of the solid and liquid from the second partially cleaned input when the second partially cleaned input flows through the second chevron baffle and into the second chamber, thereby forming a third partially cleaned input, which can be a liquid and gas mixture.

The third portion of the solid and liquid can fall from the second chevron baffle to the first portion of the vessel, such as the bottom of the vessel. For example, the second chevron baffle can be configured to direct the third portion of the solid and liquid to flow towards the bottom of the vessel.

In one or more embodiments, the vessel can include a drain line, and the third portion of the solid and liquid can fall from the second chevron baffle to the drain line and flow through the drain line to the bottom of the vessel.

In one or more embodiments, the second chevron baffle can be disposed within the interior of the vessel at a right angle to the first chevron baffle, or at an angle ranging from about 40 degrees to about 110 degrees. The second chevron baffle can have a length of 6 feet, width of 4 feet and height of 4 feet.

In one or more embodiments, the first chevron baffle and second chevron baffle can be configured to allow the input to flow of up to 6000 cubic feet per minute.

A demister baffle can be disposed in the vessel and configured to receive the third partially cleaned input, and to remove liquid therefrom, thereby forming a cleaned gas.

The liquid removed by the demister baffle can be a cleaned liquid, which can fall through the drain line to the bottom of the vessel. The cleaned liquid can include water, hydrocarbons, particulate, or combinations thereof.

The vessel can include at least one outlet for removing the solid and liquid from the vessel.

The at least one outlet can include a particulate outlet at the bottom of the vessel for removal of the solids. The particulate outlet can be disposed at an apex of a cone bottom of the vessel, and can be centrally disposed around the vertical axis of the vessel at a lowest point in the cone bottom.

The at least one outlet can include a liquid outlet for removing the liquid from the vessel. The liquid outlet can function to keep a liquid in the vessel from rising above a predetermined level.

The vessel can include a cleaned gas outlet for flowing the cleaned gas from the vessel. The cleaned gas outlet can be in fluid communication with the second chamber, and can allow the cleaned gas to flow through the inside of the vessel in a cleaned gas outlet.

The cleaned gas outlet can be in fluid communication with a flare stack, such as through a flare line. The cleaned gas can flow to the flare stack, and the flare stack can burn the cleaned gas. In one or more embodiments, the demister baffle can be disposed in the cleaned gas outlet and configured prevent a flame from the flare stack from entering into the vessel.

The vessel can include an outlet at the top of the vessel, which can connect to a safety release valve in fluid communication with a safety release outlet. The safety release valve with the safety release valve outlet can be in fluid communication with the cleaned gas outlet.

In one or more embodiments, the system can include one or more pumps that can be used for removal of the solid and liquid. For example, a catch tank can be disposed below the bottom of the vessel. The catch tank can receive the solid and liquid therefrom. The one or more pumps can be disposed in, on, or can otherwise be in fluid communication with the catch tank for pumping the solid and liquid from the catch tank.

The system can include an auger that can be used for solid and liquid removal from the bottom of the vessel.

The auger can be connected with the at least one outlet for removing the solid and liquid from the bottom of the vessel.

The auger can include a chute, and the liquid outlet can be in fluid communication with the chute to flow liquid into the chute.

The system can include a shaker, also called a scalping shaker, with a flow equalizer and a shaker screen.

The flow equalizer, also referred to as a possum belly, can receive solid and liquid from the auger and/or pump. For example, the flow equalizer can receive the solid and liquid from the chute of the auger.

The flow equalizer can create laminar flow of the liquid. An illustrative flow equalizer or possum belly can be one made by Tri-Flo International, Inc. of Willis Tex.

In one or more embodiments, the solid from the auger and/or pump can be captured on the shaker screen to separate solid from the liquid, thereby allowing the solid to dry to form a dried solid and a separated liquid.

The separated liquid can flow into a shaker tank. The shaker tank can be connected to or otherwise in fluid communication with the shaker.

The shaker can be mounted on springs for receiving the solid and liquid and forming the separated liquid and the dried solid. In operation, the separated liquid can be transferred from the shaker tank, such as by using a sump pump. A sump pump can be a submersible pit pump, such as one made by Tri-Flo International, Inc. of Willis Tex. The sump pump can be housed in a sump in the shaker tank.

In one or more embodiments, the vessel, shaker tank, auger, possum belly, a container for receiving the dried solid or combinations thereof can be disposed on a skid.

The skid can allow the system to be mounted to a trailer for transportation of the system. The skid can be formed from at least two parallel bars, and up to four parallel bars, with each parallel bar being connected by a plurality of cross beams. The parallel bars can be made of steel.

In one or more embodiments, at least one pull pipe can be mounted to one end of the skid. The pull pipes can function to allow gripping of the skid for easy movement or lifting of the skid onto a flat bed road ready trailer, such as a tractor trailer.

In one or more embodiments, the vessel can be selectively movable between two different positions relative to the skid, such as a horizontal position and vertical position.

For example, a frame can hold the vessel over the skid, and one or more hydraulic cylinders can be used to hold the vessel in the vertical position for operation of the system. The one or more hydraulic cylinders can be used to lower the vessel to the horizontal position for transporting the system.

In the horizontal position, the vessel can be disposed parallel with the skid and can be lying on the frame, allowing for transport using the skid. The vessel can be pivoted to the vertical position about base fulcrums by using the hydraulic cylinders to raise the vessel. For example, the frame can be pivoted upwards, thereby moving the vessel. In the vertical position, the vessel can be disposed at about a 90 degree angle to the skid.

In the horizontal position the vessel can be transported to a work site, such as a wellbore, and upon arrival at the work site, the vessel can be pivoted to the vertical position for operation of the system.

Each of the hydraulic cylinders can connect on one end of the frame and on another end of the skid.

A hydraulic power unit and controls for the hydraulic power unit can be used to operate the hydraulic cylinders for raising the vessel from the horizontal position to the vertical position using the frame.

The frame can be pivotably connected to the skid. The frame can have a first frame side and second frame side, which can both be formed from tubular steel or another material. The first frame side and second frame side can be formed from two parallel tubulars connected by two or three cross braces disposed at about a 90 degree angle to the parallel tubulars. Two angled connecting members can connect from one of the cross braces to a second cross brace.

The first frame side and second frame side can connect to a frame bottom. The frame bottom can include two base parallel tubulars with two horizontal base tubulars.

In one or more embodiments of the system, the frame bottom can be mounted to a pair of base fulcrums, allowing the frame bottom tubulars to pivot on the base fulcrums.

One or more embodiments of the vessel can include one or more closable manways that can provide openings into one or more portions of the vessel for cleaning, maintenance, or the like.

A first closable manway can connect to the middle section and a second closable manway can connect to the first chamber.

Turning now to the Figures, FIG. 1 depicts a perspective view of the system for capturing, separating, and containing solids, liquids, and gases, such as from a drilling gas used while drilling. For example, the drilling gas can include air, natural gas, or combinations thereof.

The system can include a vessel 18, here shown as a cylindrical vessel.

The vessel 18 can include an inlet 17 for receiving an input, such as the drilling gas.

A frame 86 can support the vessel 18. The frame 86 can have a first frame side 88, a second frame side 90, and a frame bottom 92.

In one or more embodiments, the vessel 18 can be supported or centralized on the frame using one or more brackets 87.

The frame 86 can pivot about at least two base fulcrums, such as base fulcrum 100.

The system can include a pair of hydraulic cylinders, such as hydraulic cylinder 94*a*, for raising and lowering the frame with the vessel 18 from a skid 82. For example, the hydraulic cylinder 94*a* can be connected at one end to the frame 86 and at another end to the skid 82. The hydraulic cylinder 94*a* can be connected to a hydraulic power unit 98 for operating the hydraulic cylinder 94*a*.

The vessel 18 is depicted in a horizontal position for transport of the system; however, the hydraulic cylinder 94*a* can be actuated to pivot the frame 86 and move the vessel 18 to a vertical position for operation of the system.

The vessel 18 can include a first manway 106 that can provide user access to one or more of the chambers in the vessel 18. The vessel 18 can include a second manway 108 that can provide user access to an interior of the vessel 18, such as at a middle section of the vessel 18.

The vessel 18 can include a safety release valve 33.

One or more embodiments of the system can include an auger 57 and a liquid outlet 45. The auger 57 can be in fluid communication with the vessel 18. The liquid outlet 45 can function to maintain a liquid level in the vessel 18 below a level of an opening of the auger 57.

The system can include a flow equalizer 42, and a shaker 80 with a shaker screen 44 connected to the flow equalizer 42.

When the vessel 18 is disposed in the vertical position, a flow equalizer inlet 40 of the flow equalizer 42 can be in fluid communication with a chute 61 of the auger 57 for receiving the solid and liquid therefrom. The flow equalizer inlet 40 can transmit the solid and liquid to the shaker screen 44, and the shaker screen 44 can separate the solid from the liquid, forming a separated liquid 49 and a dried solid 48, which can be a particulate.

A shaker tank 46 can receive the separated liquid 49 from the shaker 80. The shaker screen 44 can capture the dried solid 48 and transmit the dried solid 48 to a container 52 for further drying.

Figure 2:
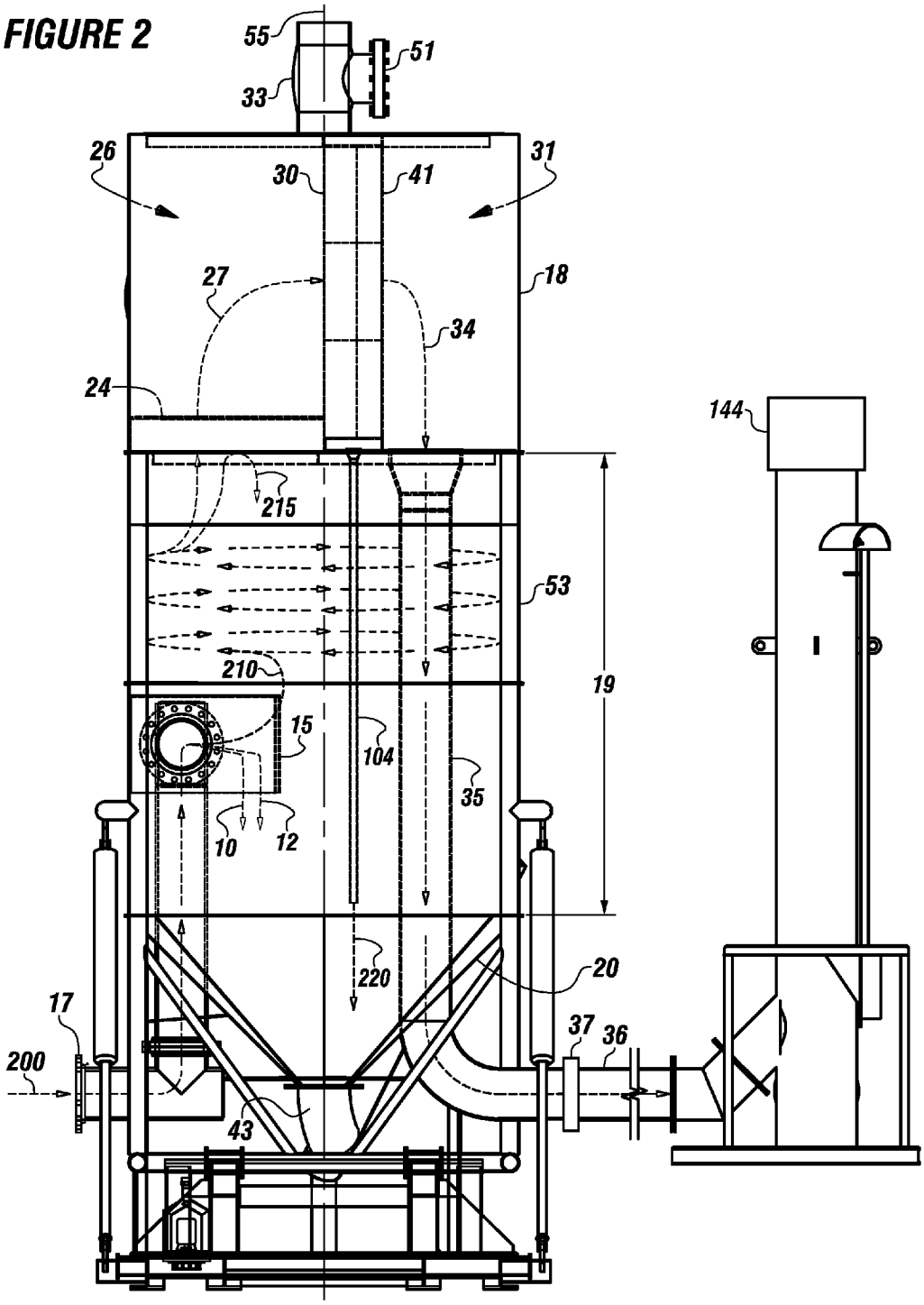
FIG. 2 depicts an end view of the system with the vessel in a vertical position depicting flow paths for solids, liquids, and gases within the vessel, according to one or more embodiments.

FIG. 2 depicts an end view of the system with the vessel 18 in an operational vertical position having a vertical axis 55, according to one or more embodiments.

The vessel 18 can have a cone bottom 20 with a particle outlet 43.

The inlet 17 can receive the input 200, such as drilling air, liquid, and solid, which can be from a well that is being drilled.

The input 200 can flow through the inlet 17 and into the interior of the middle section 19 of the vessel 18, and can impact with a target plate 15 disposed in the vessel 18.

The target plate 15 can separate the input 200 into a first portion of solid and liquid, such as a first solid 10 and first liquid 12, and into a first partially cleaned input 210.

The first solid 10 and first liquid 12 can fall downwards to the cone bottom 20 of the vessel 18. The first partially cleaned input 210 can contain portions of the solid liquid, drilling air, or combinations thereof.

The first partially cleaned input 210 can rise upwards towards a first chevron baffle 24 within the interior of the vessel 18 creating a vortex flow in the middle section 19 of the vessel 18. A vortex maintenance ring 53 can be disposed inside the middle section 19 for maintaining the vortex flow.

The first chevron baffle 24 can separate the first partially cleaned input 210 by removing a second portion of solid and liquid 215, which can include solid and liquid from the input 200, thereby forming a second partially cleaned input 27 within a first chamber 26 of the vessel 18. A pressure within the first chamber 26 can be low, such as two psi.

The vessel 18 can include a second chamber 31 that can be in fluid communication with the first chamber 26. A second chevron baffle 30 can disposed between the first chamber 26 and the second chamber 31. A demister baffle 41 can be disposed adjacent the second chevron baffle 30.

The second chevron baffle 30 and the demister baffle 41 can separate a third portion of solid and liquid 220 from the second partially cleaned input 27. The third portion of solid and liquid 220 can flow from the second chevron baffle 30 and the demister baffle 41 to the cone bottom 20, such as through a drain line 104. As such, the combination of the second chevron baffle 30 and the demister baffle 41 can form a cleaned gas 34.

The cleaned gas 34 can pass from the demister baffle 41 into the second chamber 31. A pressure within the second chamber 31 can be lower than the pressure within the first chamber 26.

The cleaned gas 34 can flow from the second chamber 31 into a cleaned gas outlet 35. The cleaned gas 34 can flow though the cleaned gas outlet 35 into a flare line 36.

A flame arrester 37 can be disposed in the flare line 36. The cleaned gas 34 can flow through the flare line 36 with the flame arrester 37, and to a flare stack 144. The flare stack 144 can burn the cleaned gas 34.

The safety release valve 33 on the vessel 18 can be in fluid communication with a safety release valve outlet 51 and can allow contents of the vessel 18 to be released, such as if the demister baffle 41 is clogged.

Figure 3:
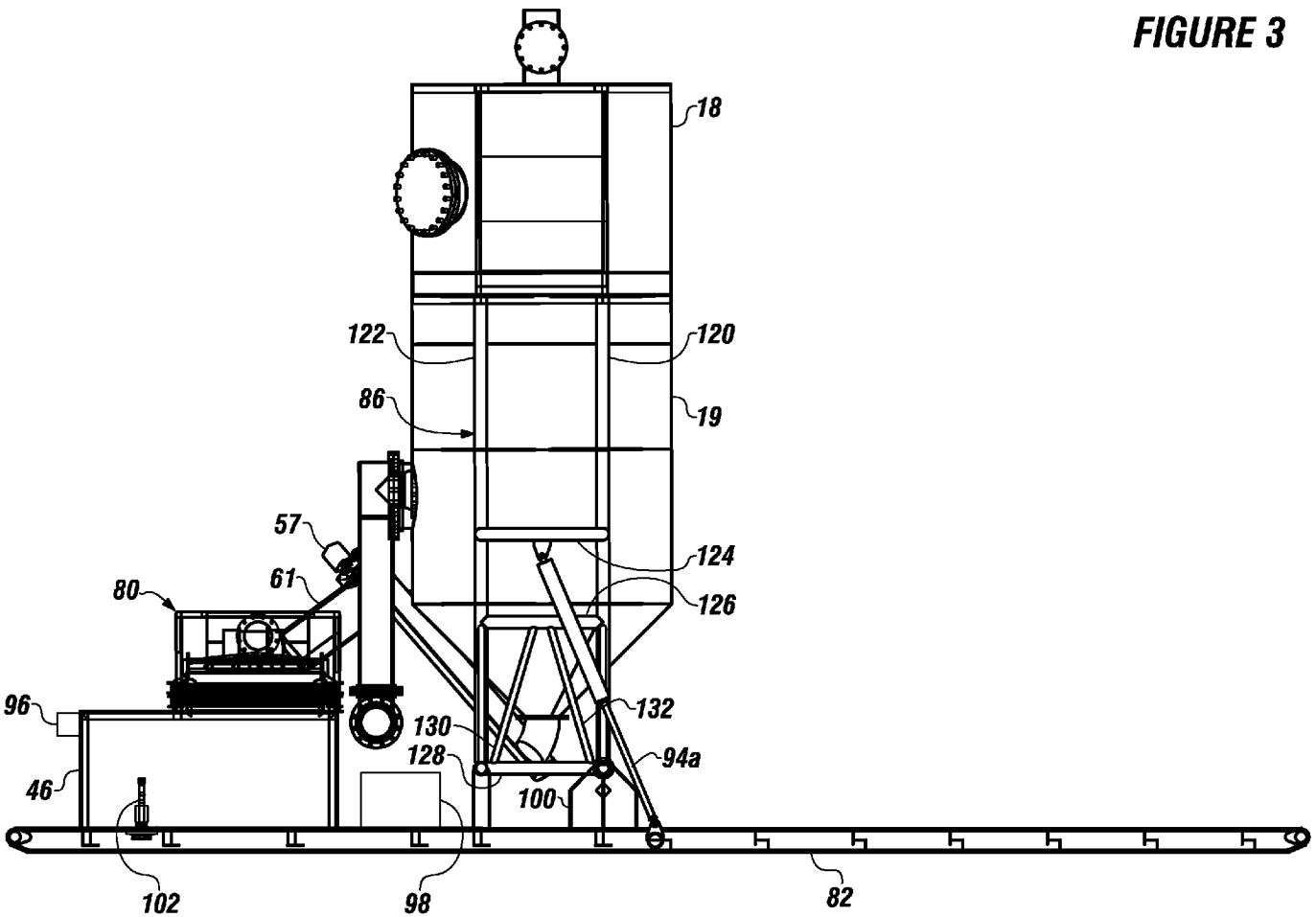
FIG. 3 depicts a side view of the system with the vessel in the vertical position, according to one or more embodiments.

FIG. 3 depicts a side view of the system with the vessel 18 in an operational vertical position, according to one or more embodiments.

The vessel 18 with the middle section 19 can be supported on the frame 86 with the base fulcrum 100.

The frame 86 can have a first parallel tubular 120, a second parallel tubular 122, a first cross brace 124, a second cross brace 126, and a third cross brace 128.

The second cross brace 126 and the third cross brace 128 can both be supported by a first angled connecting member 130 and a second angled connecting member 132. The frame 86 can be made of ½ inch hollow steel tubular or another material.

The hydraulic cylinder 94*a* can be supported by the skid 82 and can support the frame 86. The hydraulic power unit 98 can operate the hydraulic cylinder 94*a* using controls 96, which can be attached to the shaker tank 46.

The chute 61 can flow the solid and liquid from the auger 57 to the shaker 80, and a submersible pump 102 can be disposed inside the shaker tank 46 for removing the separated liquid from the shaker tank 46.

Figure 4:
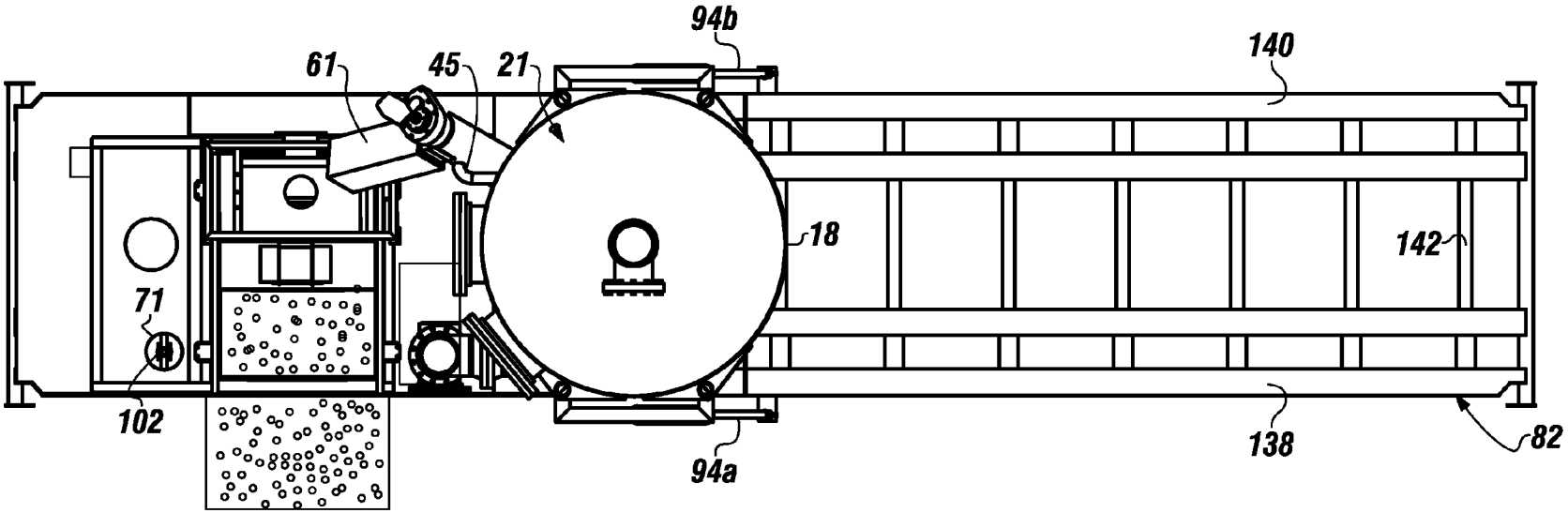
FIG. 4 depicts a top view of the system with the vessel in the vertical position, according to one or more embodiments.

FIG. 4 depicts a top view of the system with the vessel 18 disposed in the vertical position showing a top of the vessel 21, according to one or more embodiments.

The vessel 18 can rest on the skid 82, which can have a first horizontal base tubular 138 parallel to a second horizontal base tubular 140.

The skid 82 can be about 8 feet and 6 inches wide, and can have a plurality of cross beams, such as crossbeam 142.

The liquid outlet 45 can be in fluid communication with the chute 61.

A sump 71 can contain the submersible pump 102.

The hydraulic cylinders 94*a* and 94*b* can be configured to lift the vessel 18 relative to the skid 82.

Figure 5:
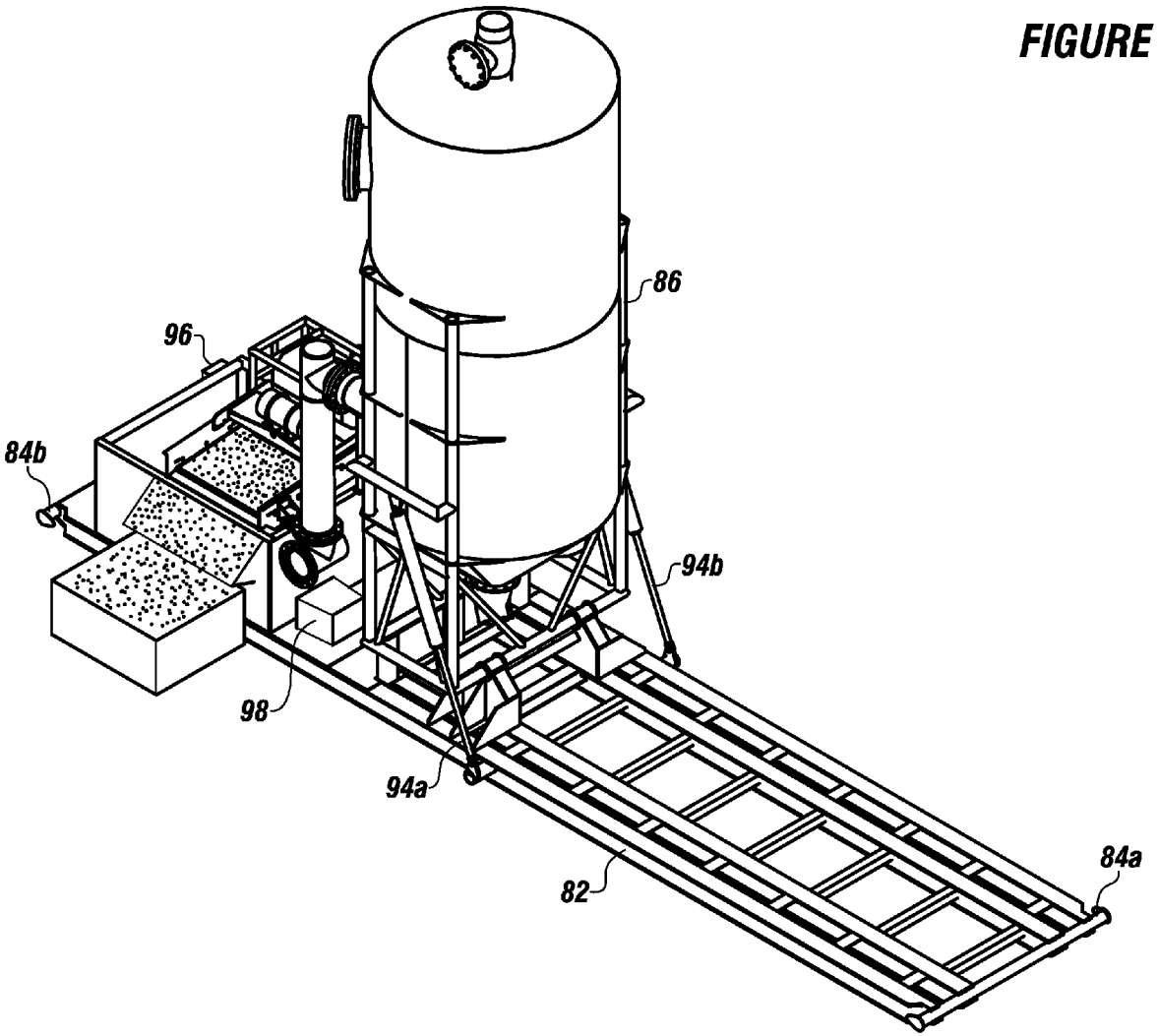
FIG. 5 depicts a perspective view of the system with the vessel in the vertical position, according to one or more embodiments.

FIG. 5 depicts a perspective view of the system in the vertical position relative to the skid 82 with a first pull pipe 84*a* and second pull pipe 84*b*, according to one or more embodiments.

Also depicted are the hydraulic cylinders 94*a* and 94*b*, the frame 86, the controls 96, and the hydraulic power unit 98.

Figure 6C:
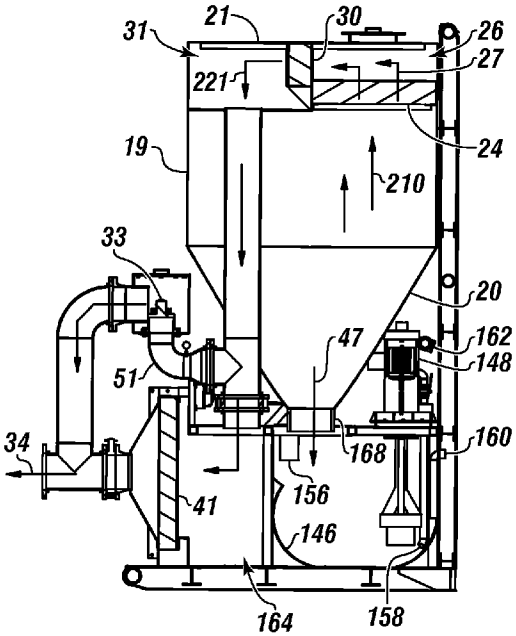
FIG. 6C depicts a cut view of the system in FIGS. 6A and 6B, according to one or more embodiments.
Figure 6B:
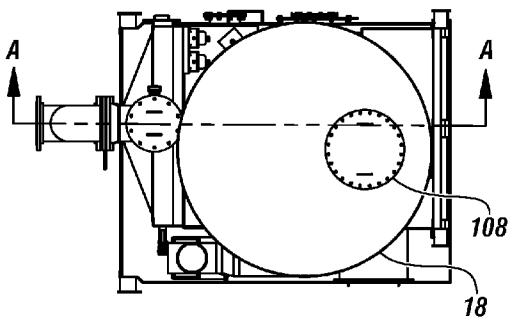
FIG. 6B depicts a top view of the system in FIG. 6A, according to one or more embodiments.
Figure 6A:
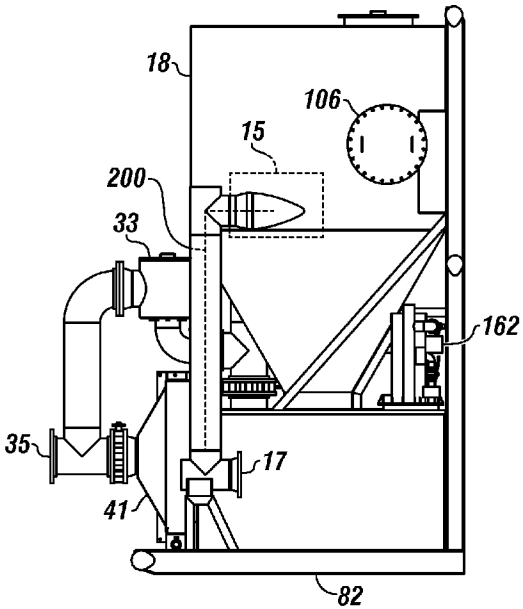
FIG. 6A depicts a side view of another embodiment of the system having a catch tank disposed below the vessel, according to one or more embodiments.

FIG. 6A depicts a side view of an embodiment of the system, FIG. 6B depicts a top view of the system shown in FIG. 6A, and FIG. 6C depicts a cut view of the system shown in FIG. 6B along line C-C.

The system can include the vessel 18, which can be mounted on the skid 82. The vessel 18 can have the top of the vessel 21, the middle section 19, and the cone bottom 20.

The vessel 18 can have the first manway 106 to provide access to the middle section 19 for cleaning, maintenance, and the like. The vessel 18 can also have the second manway 108 in the top of the vessel 21 for providing access to the top of the vessel 21 for cleaning, maintenance, and the like.

The vessel 18 can have the inlet 17 for receiving the input 200.

The vessel 18 can have the target plate 15 positioned within an interior of the vessel 18, such that the input 200 impacts the target plate 15 upon entering the interior of the vessel 18.

Upon impact with the target plate 15, at least a solid and liquid 47 can be separated from the input 200, and can flow towards a first portion of the vessel 18, such as towards the cone bottom 20.

The remainder of the input 200, also referred to as the first partially cleaned input 210, can flow towards a second portion of the vessel 18, such as towards the top of the vessel 21.

The first partially cleaned input 210 can flow through a first baffle, such as the first chevron baffle 24, which can further separate out the solid and liquid 47 from the first partially cleaned input 210, thereby forming the second partially cleaned input 27 within the first chamber 26 in the vessel 18.

The second partially cleaned input 27 can flow through a second baffle, such as the second chevron baffle 30, which can further separate out the solid and liquid 47 from the second partially cleaned input 27, thereby forming a third partially cleaned input 221 which can be a liquid and gas mixture, within the second chamber 31 in the vessel 18.

The third partially cleaned input 221 can flow into a demister chamber 164 to pass through the demister baffle 41 for removing liquid from the third partially cleaned input 221, thereby forming the cleaned gas 34. The cleaned gas 34 can flow from the vessel 18 through the cleaned gas outlet 35, such as to the flare stack.

In operation, if the demister baffle 41 is clogged or if the cleaned gas 34 is otherwise not flowing through the demister baffle 41, the cleaned gas 34 can flow through the safety release valve outlet 51 and the safety release valve 33 to exit the cleaned gas outlet 35. The safety release valve outlet 51 and the safety release valve 33 can be in fluid communication with the cleaned gas outlet 35.

The solid and liquid 47 can flow out of at least one outlet 168, which can be at the cone bottom 20. The solid and liquid 47 can flow into a catch tank 146 disposed below the vessel 18.

The catch tank 146 can have a liquid level float 156, which can provide an alarm if the level within the catch tank 146 exceeds a predetermined limit.

A pump 148 can be in fluid communication with the catch tank 146 for removing the solid and liquid 47 therefrom. For example, the pump 148 can pump the solid and liquid 47 through a pump discharge 162 to the shaker or a scalping shaker and possum belly unit for separation of the solid from the liquid.

A slurry liquid inlet 160 can be in fluid communication with the catch tank 146 for receiving recycled solid and liquid 47 from the shaker 80 or the scalping shaker and the possum belly unit, thereby allowing the system to maintain a level of liquid within the catch tank 146.

The pump 148 can also include an agitating jet 158, which can cycle liquid to a bottom of the catch tank 146 to prevent solid from settling thereon.

Figure 7:
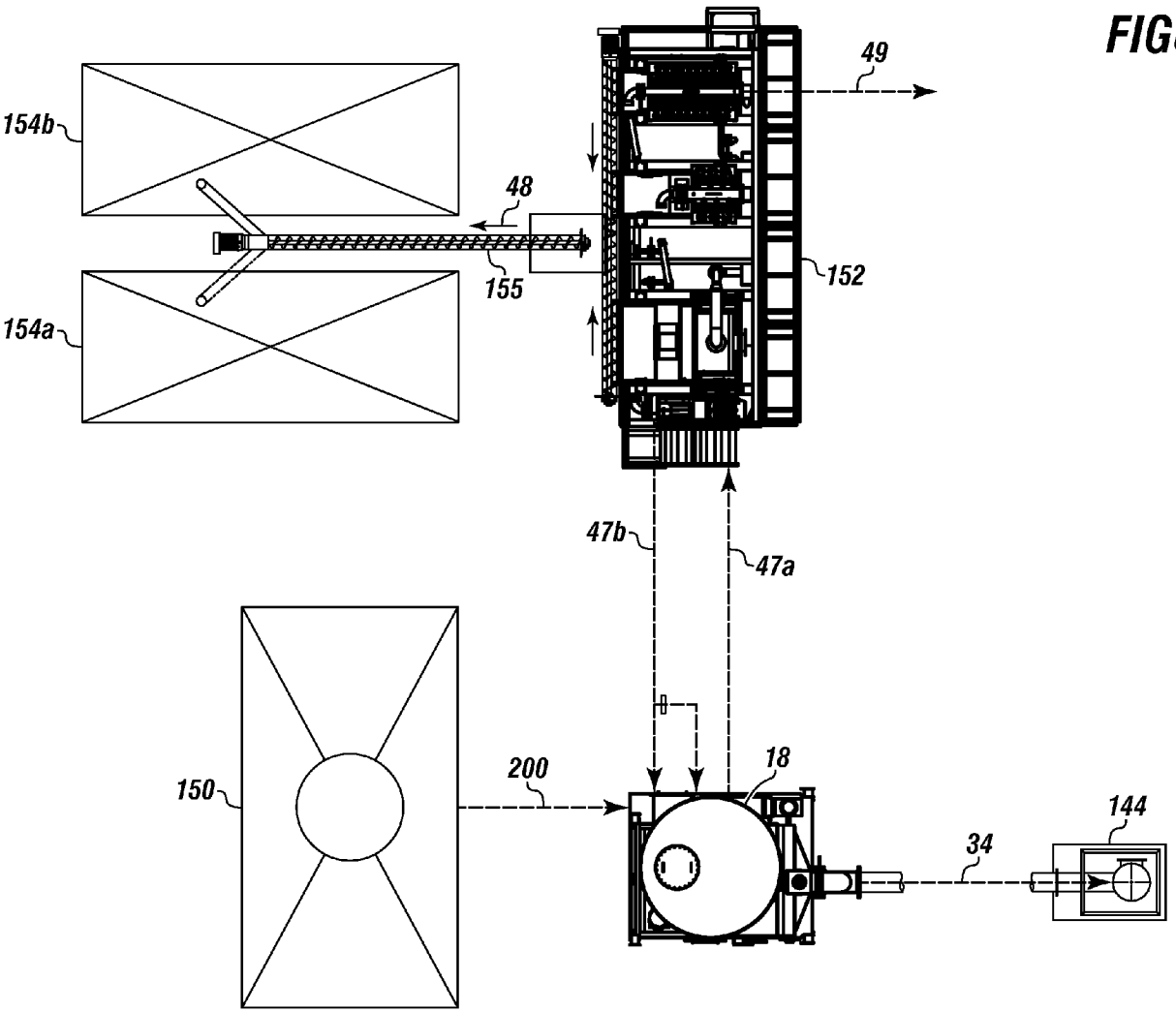
FIG. 7 depicts an embodiment of the system with the vessel in communication with a rig, flare stack, and scalping shaker and possum belly unit.

FIG. 7 depicts the system with the vessel 18 in fluid communication with a rig 150 for receiving the input 200 therefrom, according to one or more embodiments.

The vessel 18 can receive the input 200 to separate the solid, liquid, and gas within the input 200.

The vessel 18 can be in fluid communication with the flare stack 144. The separated gas, or the cleaned gas 34, can flow from the vessel 18 to the flare stack 144 to be burned.

The vessel 18 can be in fluid communication with the scalping shaker and possum belling unit 152. The solid and liquid 47*a* can flow from the vessel 18 into the scalping shaker and possum belling unit 152.

The scalping shaker and possum belling unit 152 can separate the solid and liquid 47*a*, forming the dried solid 48 and the separated liquid 49.

The dried solid 48 can be stored, such as in roll off boxes 154*a* and 154*b*. For example, a dried solid auger 155 can be used to move the dried solid 48 to the roll off boxes 154*a* and 154*b*.

The separated liquid 49 can be recycled to the rig 150 for reuse in drilling operations.

Portions of the solid and liquid 47*b* can be recycled back through the vessel 18 for further separation and for maintaining a level of liquid within the catch tank of the vessel 18.

Figure 8:
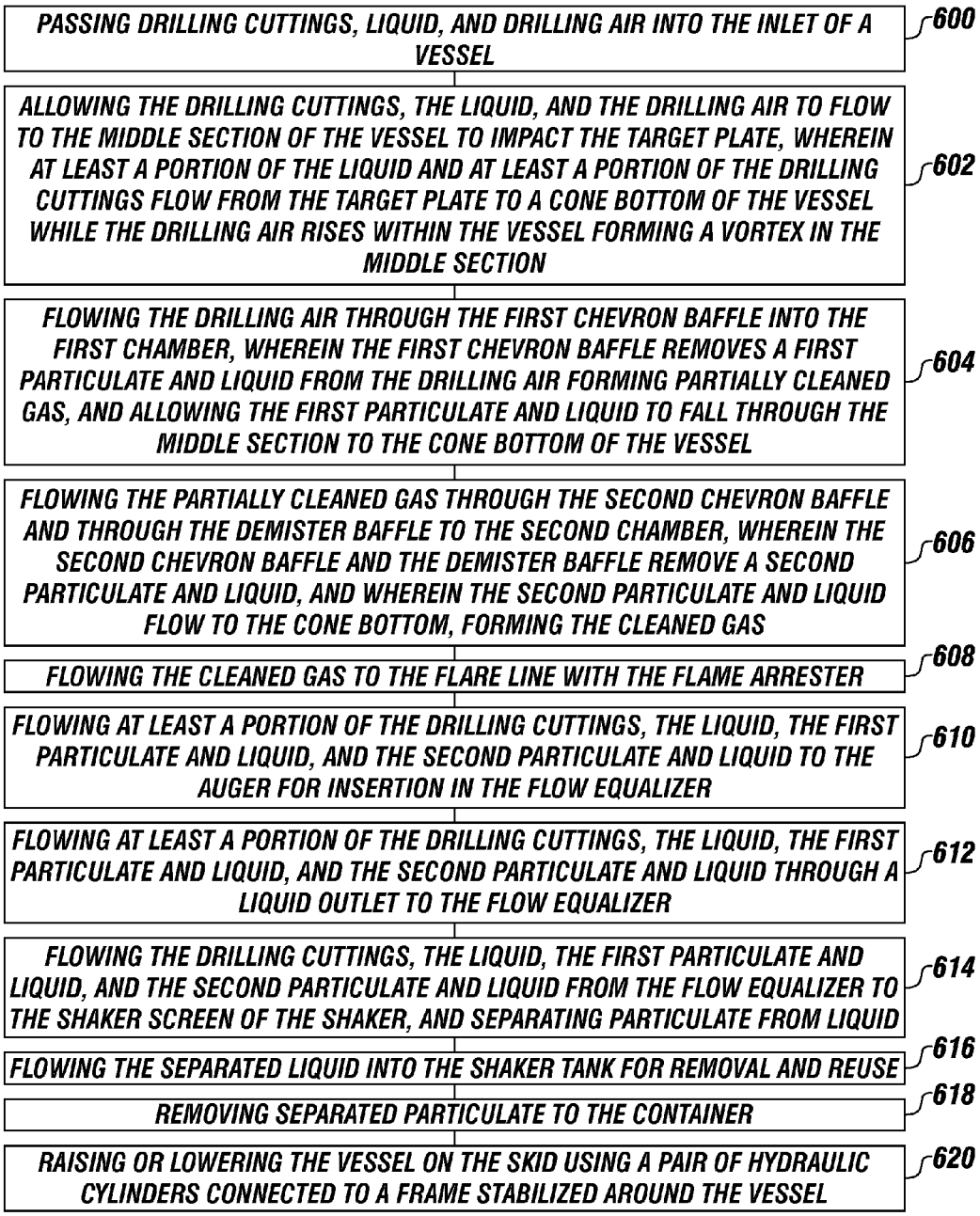
FIG. 8 depicts an embodiment of a method for separating and containing solids, liquids, and gases.

FIG. 8 depicts an embodiment of a method for containing and separating drilling cuttings and liquid from drilling air used to air drill a well.

The method can include passing drilling cuttings, liquid, and drilling air into the inlet of the vessel, as illustrated by box 600.

The method can include allowing the drilling cuttings, the liquid, and the drilling air to flow to the middle section of the vessel to impact the target plate, wherein at least a portion of the liquid and at least a portion of the drilling cuttings flow from the target plate to a cone bottom of the vessel while the drilling air rises within the vessel forming a vortex in the middle section, as illustrated by box 602.

The method can include flowing the drilling air through the first chevron baffle into the first chamber, wherein the first chevron baffle removes a first particulate and liquid from the drilling air forming partially cleaned gas, and allowing the first particulate and liquid to fall through the middle section to the cone bottom of the vessel, as illustrated by box 604.

The method can include flowing the partially cleaned gas through the second chevron baffle and through the demister baffle to the second chamber, wherein the second chevron baffle and the demister baffle remove a second particulate and liquid, and wherein the second particulate and liquid flow to the cone bottom, forming the cleaned gas, as illustrated by box 606.

The method can include flowing the cleaned gas to the flare line with the flame arrester, as illustrated by box 608.

The method can include flowing at least a portion of the drilling cuttings, the liquid, the first particulate and liquid, and the second particulate and liquid to the auger for insertion in the flow equalizer, as illustrated by box 610.

The method can include flowing at least a portion of the drilling cuttings, the liquid, the first particulate and liquid, and the second particulate and liquid through a liquid outlet to the flow equalizer, as illustrated by box 612.

The method can include flowing the drilling cuttings, the liquid, the first particulate and liquid, and the second particulate and liquid from the flow equalizer to the shaker screen of the shaker, and separating particulate from liquid, as illustrated by box 614.

The method can include flowing the separated liquid into the shaker tank for removal and reuse, as illustrated by box 616.

The method can include removing separated particulate to the container, as illustrated by box 618.

The method can include raising or lowering the vessel on the skid using a pair of hydraulic cylinders connected to a frame stabilized around the vessel, as illustrated by box 620.

Figure 9A:
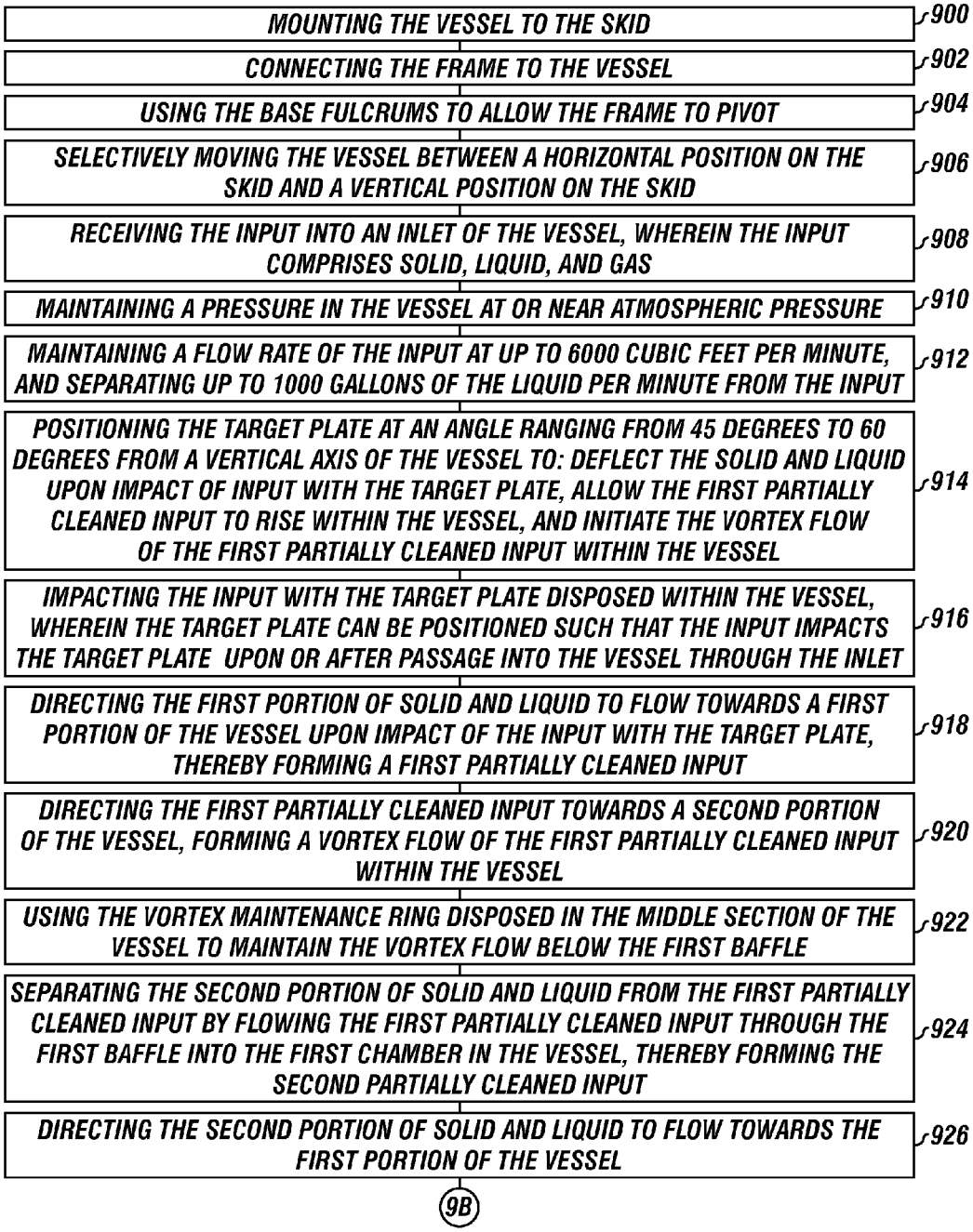
FIG. 9 depicts another embodiment of a method for separating and containing solids, liquids, and gases.
Figure 9B:
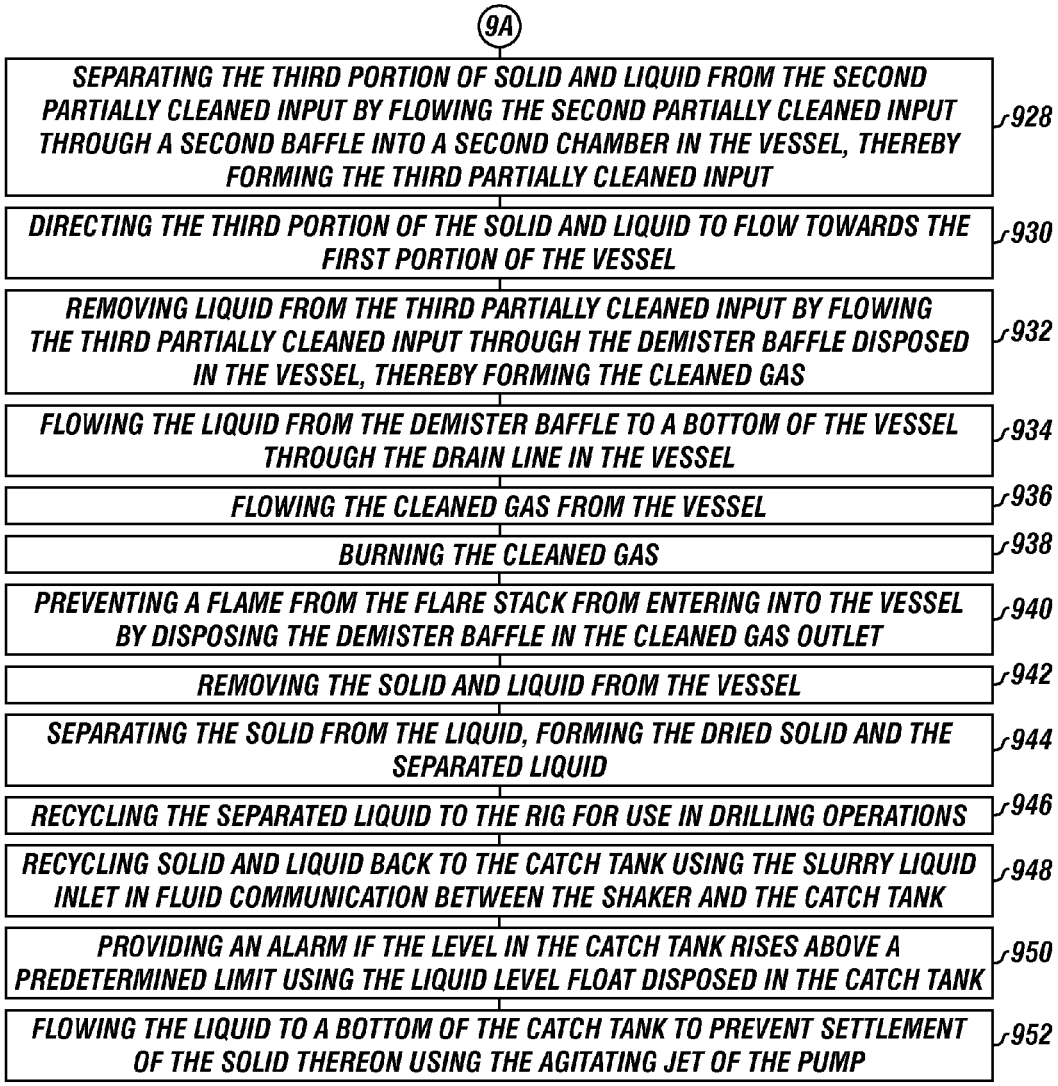

FIG. 9 depicts another embodiment of the method for containing and separating solids, liquids, and gases.

The method can include mounting the vessel to the skid, as illustrated by box 900.

The method can include connecting the frame to the vessel, as illustrated by box 902.

The method can include using the base fulcrums to allow the frame to pivot, as illustrated by box 904.

The method can include selectively moving the vessel between a horizontal position on the skid and a vertical position on the skid, as illustrated by box 906.

For example, one or more hydraulic cylinders can be used to selectively move the vessel.

The method can include receiving the input into an inlet of the vessel, wherein the input comprises solid, liquid, and gas, as illustrated by box 908.

The method can include maintaining a pressure in the vessel at or near atmospheric pressure, as illustrated by box 910.

The method can include maintaining a flow rate of the input at up to 6000 cubic feet per minute, and separating up to 1000 gallons of the liquid per minute from the input, as illustrated by box 912.

The method can include positioning the target plate at an angle ranging from 45 degrees to 60 degrees from the vertical axis of the vessel to: deflect the solid and liquid upon impact of the input with the target plate, allow the first partially cleaned input to rise within the vessel, and initiate the vortex flow of the first partially cleaned input within the vessel, as illustrated by box 914.

The method can include impacting the input with the target plate disposed within the vessel, wherein the target plate can be positioned such that the input impacts the target plate upon or after passage into the vessel through the inlet, as illustrated by box 916.

The method can include directing the first portion of solid and liquid to flow towards a first portion of the vessel upon impact of the input with the target plate, thereby forming the first partially cleaned input, as illustrated by box 918.

The method can include directing the first partially cleaned input towards a second portion of the vessel, forming a vortex flow of the first partially cleaned input within the vessel, as illustrated by box 920.

The method can include using the vortex maintenance ring disposed in the middle section of the vessel to maintain the vortex flow below the first baffle, as illustrated by box 922.

The method can include separating the second portion of solid and liquid from the first partially cleaned input by flowing the first partially cleaned input through a first baffle into the first chamber in the vessel, thereby forming the second partially cleaned input, as illustrated by box 924.

The method can include directing the second portion of solid and liquid to flow towards the first portion of the vessel, as illustrated by box 926.

The method can include separating the third portion of solid and liquid from the second partially cleaned input by flowing the second partially cleaned input through a second baffle into the second chamber in the vessel, thereby forming the third partially cleaned input, as illustrated by box 928.

The method can include directing the third portion of the solid and liquid to flow towards the first portion of the vessel, as illustrated by box 930.

The method can include removing liquid from the third partially cleaned input by flowing the third partially cleaned input through the demister baffle disposed in the vessel, thereby forming the cleaned gas, as illustrated by box 932.

The method can include flowing the liquid from the demister baffle to a bottom of the vessel through the drain line in the vessel, as illustrated by box 934.

The method can include flowing the cleaned gas from the vessel, as illustrated by box 936.

The method can include burning the cleaned gas, as illustrated by box 938.

For example, the cleaned gas can be burned using the flare stack in fluid communication with the cleaned gas outlet.

The method can include preventing a flame from the flare stack from entering into the vessel by disposing the demister baffle in the cleaned gas outlet, as illustrated by box 940.

The method can include removing the solid and liquid from the vessel, as illustrated by box 942.

For example, an auger connected with the at least one outlet can be used to remove the solid and liquid from the vessel, or the catch tank disposed below the vessel can receive the solid and liquid from the at least one outlet, and a pump in fluid communication with the catch tank can remove the solid and liquid from the catch tank.

The method can include separating the solid from the liquid, forming the dried solid and the separated liquid, as illustrated by box 944.

For example, the solid can be separated from the liquid using the shaker with the shaker screen. The shaker can be configured to receive the solid and liquid from the auger or the pump using the flow equalizer, thereby forming the separated liquid and the dried solid. The separated liquid can flow to the shaker tank, and be transferred from the shaker tank using the submersible pump in the shaker tank. The submersible pump can be contained in the sump.

The method can include recycling the separated liquid to the rig for use in drilling operations, as illustrated by box 946.

The method can include recycling solid and liquid back to the catch tank using the slurry liquid inlet in fluid communication between the shaker and the catch tank, as illustrated by box 948.

The method can include providing an alarm if the level in the catch tank rises above a predetermined limit using the liquid level float disposed in the catch tank, as illustrated by box 950.

The method can include flowing the liquid to a bottom of the catch tank to prevent settlement of the solid thereon using the agitating jet of the pump, as illustrated by box 952.

While these embodiments have been described with emphasis on the embodiments, it should be understood that within the scope of the appended claims, the embodiments might be practiced other than as specifically described herein.

What is claimed is:

1. A system for containing and separating solids, liquids, and gases, the system comprising a vessel comprising:

a. an inlet for receiving an input, wherein the input comprises solid, liquid, and gas;

b. a target plate disposed within the vessel, wherein the target plate is positioned such that the input impacts the target plate upon or after passage into the vessel through the inlet, and wherein the target plate is configured to:

(i) direct a first portion of solid and liquid to flow towards a first portion of the vessel upon impact of the input with the target plate, thereby forming a first partially cleaned input; and (ii) direct the first partially cleaned input towards a second portion of the vessel, forming a vortex flow of the first partially cleaned input within the vessel;

c. a first baffle disposed in the vessel forming a first chamber therein, wherein the first baffle is configured to:

(i) separate a second portion of solid and liquid from the first partially cleaned input when the first partially cleaned input flows through the first baffle into the first chamber, thereby forming a second partially cleaned input; and (ii) direct the second portion of solid and liquid to flow towards the first portion of the vessel;

d. a second baffle disposed in the vessel forming a second chamber, wherein the second baffle is configured to:
(i) separate a third portion of solid and liquid from the second partially cleaned input when the second partially cleaned input flows through the second baffle into the second chamber, thereby forming a third partially cleaned input; and
(ii) direct the third portion of the solid and liquid to flow towards the first portion of the vessel;
e. a demister baffle disposed in the vessel and configured to receive the third partially cleaned input and remove liquid therefrom, thereby forming a cleaned gas;
f. a cleaned gas outlet for flowing the cleaned gas from the vessel; and
g. at least one outlet for removing the solid and liquid from the vessel.

2. The system of claim 1, wherein the first portion of the vessel is a bottom of the vessel, wherein the second portion of the vessel is a top of the vessel, and wherein the vortex flow is formed in a middle section of the vessel.

3. The system of claim 2, further comprising a vortex maintenance ring disposed in the middle section having at least a forty-five degree angle to the vertical axis of the vessel for maintaining the vortex flow below the first baffle.

4. The system of claim 1, wherein the first baffle and the second baffle are both chevron baffles.

5. The system of claim 1, wherein the vessel is mounted to the skid.

6. The system of claim 5, wherein the vessel is selectively movable between a horizontal position on the skid and a vertical position on the skid.

7. The system of claim 6, further comprising:
a. a frame;
b. a pair of base fulcrums allowing the frame to pivot;
c. one or more hydraulic cylinders, wherein each hydraulic cylinder is connected at one end to the frame and at another end to the skid; and
d. a hydraulic power unit for raising the vessel from the horizontal position on the skid to the vertical position on the skid using the one or more hydraulic cylinders.

8. The system of claim 1, further comprising a drain line in the vessel for flowing the liquid from the demister baffle to a bottom of the vessel.

9. The system of claim 1, further comprising a safety release valve with a safety release valve outlet in fluid communication with the cleaned gas outlet, allowing the cleaned gas to bypass the demister baffle.

10. The system of claim 1, further comprising a flare stack in fluid communication with the cleaned gas outlet for burning the cleaned gas.

11. The system of claim 10, wherein the demister baffle is disposed in the cleaned gas outlet and configured prevent a flame from the flare stack from entering into the vessel.

12. The system of claim 1, wherein the system is configured to operate at or near atmospheric pressure.

13. The system of claim 1, wherein:
a. the solid comprises drilling cuttings;
b. the liquid comprises water, hydrocarbons, or combinations thereof; and
c. the gas comprises air, natural gas, or combination thereof.

14. The system of claim 1, wherein the vessel is adapted to allow for a flow rate of up to 6000 cubic feet of the input per minute for separating up to 1000 gallons of the liquid per minute from the input.

15. The system of claim 1, wherein the target plate is positioned at an angle ranging from 45 degrees to 60 degrees from a vertical axis of the vessel, and wherein the angle of the target plate:
a. allows for deflection of the first portion of the solid and liquid upon impact of input with the target plate;
b. allows the first partially cleaned input to rise within the vessel; and
c. initiates the vortex flow of the first partially cleaned input within the vessel.

* * * * *